US010053940B2

(12) United States Patent
Coats

(10) Patent No.: US 10,053,940 B2
(45) Date of Patent: Aug. 21, 2018

(54) PRE-MILLED WINDOWS HAVING A COMPOSITE MATERIAL COVERING

(71) Applicant: Halliburton Energy Services, Inc., Houston, TX (US)

(72) Inventor: Alan Coats, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 224 days.

(21) Appl. No.: 15/022,894

(22) PCT Filed: Nov. 8, 2013

(86) PCT No.: PCT/US2013/069072

§ 371 (c)(1),
(2) Date: Mar. 17, 2016

(87) PCT Pub. No.: WO2015/069269

PCT Pub. Date: May 14, 2015

(65) Prior Publication Data

US 2016/0230488 A1 Aug. 11, 2016

(51) Int. Cl.

| | |
|---|---|
| ***E21B 29/06*** | (2006.01) |
| ***E21B 7/06*** | (2006.01) |
| ***E21B 17/00*** | (2006.01) |

(52) U.S. Cl.

CPC ..... *E21B 29/06* (2013.01); *E21B 7/06* (2013.01); *E21B 7/061* (2013.01); *E21B 17/00* (2013.01)

(58) Field of Classification Search

None

See application file for complete search history.

(56) References Cited

U.S. PATENT DOCUMENTS 3,234,723 A * 2/1966 Brown ..... E21B 17/20 138/129

5,507,346 A 4/1996 Gano et al.

(Continued)

FOREIGN PATENT DOCUMENTS

CN 1644869 A 7/2005
CN 1711407 A 12/2005

(Continued)

OTHER PUBLICATIONS

Bosworth, Steve, et al. "Key issues in multilateral technology." Oilfield Review 10.4 (1998): 14-28.

(Continued)

*Primary Examiner* — Shane Bomar

(74) *Attorney, Agent, or Firm* — McGuire Woods LLP

(57) ABSTRACT

A casing section comprising: a body comprising a wall; a window, wherein the window is an opening in the wall of the body; and a covering, wherein the covering: (A) is composed of a composite material; (B) is located on the outer surface of the body; (C) covers the window; and (D) spans at least a sufficient distance beyond the perimeter of the window such that the casing section has a desired pressure rating at the location of the window. A method of creating a lateral wellbore in a subterranean formation comprising: introducing a casing string into a wellbore, wherein the casing string comprises at least one casing section; drilling through at least a portion of the covering from the inside of the casing string to expose the window; and forming the lateral wellbore adjacent to the exposed window.

19 Claims, 4 Drawing Sheets

(56) References Cited

U.S. PATENT DOCUMENTS

| | | | | |
|---|---|---|---|---|
| 5,564,503 | A * | 10/1996 | Longbottom | E21B 7/061 166/117.6 |
| 6,012,526 | A | 1/2000 | Jennings et al. | |
| 6,041,855 | A * | 3/2000 | Nistor | E21B 17/00 166/242.1 |
| 6,047,774 | A | 4/2000 | Allen | |
| 6,065,209 | A * | 5/2000 | Gondouin | E21B 29/06 29/508 |
| 6,206,111 | B1 | 3/2001 | Nistor | |
| 6,883,611 | B2 * | 4/2005 | Smith | E21B 41/0042 166/117.6 |
| 6,913,082 | B2 | 7/2005 | McGlothen et al. | |
| 8,371,368 | B2 * | 2/2013 | Steele | E21B 29/06 166/313 |
| 8,602,097 | B2 * | 12/2013 | Hepburn | E21B 41/0042 166/117.5 |
| 2002/0003040 | A1 | 1/2002 | Brunet | |
| 2004/0040707 | A1 * | 3/2004 | Dusterhoft | E21B 17/206 166/279 |
| 2009/0199419 | A1 | 8/2009 | Hepburn | |
| 2009/0288817 | A1 | 11/2009 | Parlin et al. | |
| 2009/0288833 | A1 | 11/2009 | Graham et al. | |
| 2011/0226467 | A1 | 9/2011 | Hebpurn et al. | |
| 2011/0240283 | A1 | 10/2011 | Steele et al. | |
| 2012/0267121 | A1 | 10/2012 | Levie | |
| 2013/0284458 | A1 * | 10/2013 | Dancer | E21B 29/06 166/380 |

FOREIGN PATENT DOCUMENTS

| | | | | |
|---|---|---|---|---|
| CN | 101718173 | A | 6/2010 | |
| EP | 2088282 | A2 | 8/2009 | |
| RU | 2245439 | C1 | 1/2005 | |
| RU | 2468916 | C1 | 12/2012 | |
| RU | 2473769 | C1 | 1/2013 | |
| WO | WO-2017069774 | A1 * | 4/2017 | E21B 7/04 |

OTHER PUBLICATIONS

Langley, Diane. "Multilateral completions on rise but still a niche." Drilling contractor 67.4 (2011): 90-97.

J. Misselbrook. "Coiled tubing applications." Journal of Canadian Petroleum Technology, Jun. 2010.

International Search Report and Written Opinion dated Aug. 11, 2014; International PCT Application No. PCT/US2013/069072.

European Search Report dated Mar. 2, 2017; European Patent Application No. 13896979.5.

Russian Search Report dated Feb. 8, 2017, Russian Patent Application No. 2016113290.

Singapore Search Report dated Jun. 14, 2017; Singapore Patent Application No. 11201601556R.

Chinese Office Action date issued by Chinese Patent Office Apr. 6, 2017 and dated Jun. 2, 2017; Chinese Patent Application No. 201380079914.5.

* cited by examiner

PRE-MILLED WINDOWS HAVING A COMPOSITE MATERIAL COVERING

TECHNICAL FIELD

Lateral wellbores are formed by drilling through a window in a section of casing. The window can be pre-milled. Pre-milled windows are generally covered with a material to provide structural integrity and create a fluid seal to the casing section.

BRIEF DESCRIPTION OF THE DRAWINGS

The features and advantages of certain embodiments will be more readily appreciated when considered in conjunction with the accompanying figures. The figures are not to be construed as limiting any of the preferred embodiments.

DETAILED DESCRIPTION OF THE INVENTION

Figure 1A:
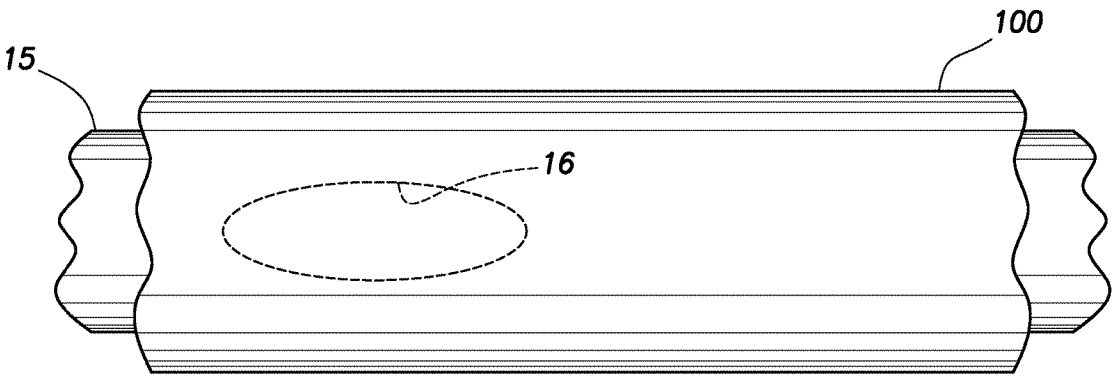
FIG. 1A is a schematic illustration of a section of casing containing a pre-milled window and a covering.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more layers of composite material, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, or an injection well. As used herein, a "well" includes at least one wellbore. The wellbore is drilled into a subterranean formation. The subterranean formation can be a part of a reservoir or adjacent to a reservoir. A wellbore can include vertical, inclined, and horizontal portions, and it can be straight, curved, or branched. As used herein, the term "wellbore" includes any cased, and any uncased, open-hole portion of the wellbore.

A drill bit can be used to form a primary wellbore. A drill string can be used to aid the drill bit in drilling through the subterranean formation to form the wellbore. The drill string can include a drilling pipe. During drilling operations, a drilling fluid, sometimes referred to as a drilling mud, may be circulated downwardly through the drilling pipe, and back up the annulus between the wall of the wellbore and the outside of the drilling pipe. The drilling fluid performs various functions, such as cooling the drill bit, maintaining the desired pressure in the well, and carrying drill cuttings upwardly through the wellbore annulus.

After the primary wellbore is drilled, a tubing string, called casing, can be placed into the wellbore. The casing can be cemented in the wellbore by introducing a cement composition in the annulus between the wall of the wellbore and the outside of the casing. The cement can help stabilize and secure the casing in the wellbore.

It is often desirable to form one or more lateral wellbores extending into a subterranean formation from a primary wellbore. A lateral wellbore can be created in a vertical, inclined, or horizontal portion of the primary wellbore or in multiple locations of combinations thereof. In order to form a lateral wellbore, a window can first be created. This is generally accomplished by placing a mill in the primary wellbore. The mill includes a mill bit, which can be the same as, or similar to, the drill bit that was used to form the primary wellbore. The mill can be attached to a drill string, which is located inside the casing. A drilling fluid is circulated downwardly through the drill string and up through the annular space between the outside of the drill string and the inside of the casing. A mill diverter can be placed at a location adjacent to the desired window location. An example of a common mill diverter is a whipstock. The mill diverter includes a sloped portion, commonly called a tapered face, where the sloped portion is much like the hypotenuse of a right triangle. A setting mechanism can be used to secure the mill diverter to the inside of the casing and help the diverter remain stationary.

The mill is then advanced through the primary wellbore until it engages the tapered face of the mill diverter. The mill is then directed laterally, i.e., in a direction away from a central axis of the primary wellbore, towards the casing. The mill is advanced down the mill diverter until the mill has cut through the casing and the cement, and penetrates the subterranean formation. The mill bit is generally removed from the primary wellbore by removing the drilling string so the mill bit can be switched out with a drill bit. The drill bit can then be used to extend the lateral wellbore a desired distance into the subterranean formation. A casing or liner can then be inserted into the lateral wellbore. The casing or liner of the lateral wellbore can be connected to the casing in the primary wellbore such that fluid is directed from the lateral wellbore and into the primary wellbore (or vice versa), without fluid leakage into the formation. The casing or liner can also be cemented in the lateral wellbore in the same manner as cementing was performed in the primary wellbore.

Of course there can be more than one lateral wellbore formed. There can also be one or more secondary laterals that extend off of a primary lateral to create a branching network of wellbores. As used herein, the term "lateral wellbore" means a wellbore that extends off of a primary wellbore or off of another lateral wellbore, for example, a secondary, tertiary, and so on, lateral wellbore.

Several issues can occur during traditional window creation. For example, there can be a significant amount of debris that is created when the mill bit mills through the casing, which is commonly made of steel. Another example of an issue is it can be quite costly and time consuming to have to remove the mill bit in order to replace it with a drill bit after the window has been created.

Previous attempts to overcome these and other issues include pre-milling a window in a section of casing prior to installation in a primary wellbore. The pre-milled window has to be sealed to prevent fluid from prematurely flowing through the window. Previous attempts to seal a pre-milled window include placing a material within the opening of the pre-milled window. However, these attempts are not reliable and can lead to fluid leakage and a loss in structural and pressure integrity of the casing section at the location of the pre-milled window. Therefore, there is a need for improved seals for pre-milled windows that are capable of maintaining both structural and pressure integrity of the casing section.

It has been discovered that a composite material can be applied to the outside of a section of casing containing a pre-milled window. The sealing area can be larger than the perimeter of the window, thereby increasing the pressure integrity of the seal. The composite material can include at least one structural layer, thereby increasing the structural integrity of the seal.

According to an embodiment, a casing section comprises: a body comprising a wall; a window, wherein the window is an opening in the wall of the body; and a covering, wherein the covering: (A) is composed of a composite material; (B) is located on the outer surface of the body; (C) covers the window; and (D) spans at least a sufficient distance beyond the perimeter of the window such that the casing section has a desired pressure rating at the location of the window.

According to another embodiment, a method of creating a lateral wellbore in a subterranean formation comprises: introducing a casing string into a wellbore; drilling through at least a portion of the covering from the inside of the casing string to expose the window; and forming the lateral wellbore adjacent to the exposed window.

Figure 1B:
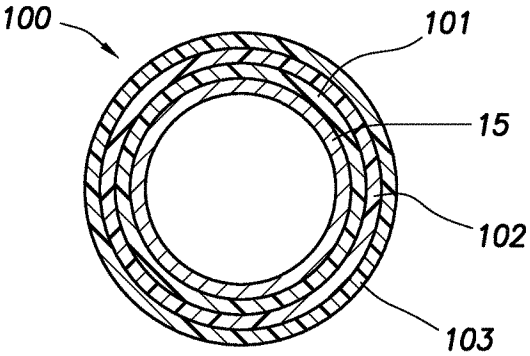
FIG. 1B is a cross-sectional illustration of the section of casing and the covering showing the layers of a composite material making up the covering according to an embodiment.

Turning to the Figures, FIG. 1A depicts the casing section 15, which can be part of a casing string. FIG. 1B depicts the covering 100 according to certain embodiments. The casing section 15 comprises a wall, shown best in FIG. 1B. The casing section 15 also comprises a pre-milled window 16, wherein the window is an opening in the wall of the body of the casing section 15. Although depicted in FIG. 1A as being oblong in shape, the window 16 can be any desired shape and size. For example, the window 16 can be oblong, circular, square, rectangular, pyramidal, etc. in shape. Preferably, the shape and size of the window 16 are selected such that a lateral wellbore can be formed without having to enlarge the perimeter of the pre-milled window. In other words, when drilling the lateral wellbore, the drill bit preferably does not engage the wall of the body of the casing section 15 at the location of the window 16, which would increase the amount of debris created during lateral wellbore formation. Of course, some of the casing section 15 can be drilled during the lateral wellbore formation.

The casing section 15 also comprises a covering 100. The covering 100 is composed of a composite material. As used herein, a "composite material" means a material that is made up of two or more layers of substances having different physical and/or chemical properties. Accordingly, the composite material can include at least a first layer 101 and a second layer 102. The composite material can also include a third layer 103, a fourth layer (not shown) and so on. According to an embodiment, the first layer 101 is a pressure-bearing layer. The pressure-bearing layer can withstand a specific pressure differential. As used herein, the term "withstand," and all grammatical variations thereof means that the material does not chip, crack, break, warp, or otherwise sustain any type of deformation that would allow a fluid to flow through or past the material. The first layer 101 can be impermeable and inert to fluids that contact the first layer, for example fluids located inside the casing string. The first layer 101 can be composed of a polymeric substance, for example a shrink-fit material or a plastic. According to an embodiment, the first layer 101 has a thickness, a top surface, and a bottom surface. The thickness of the first layer 101 can be selected such that at least the first layer can withstand the specific pressure differential. The thickness can vary and can be dependent on the exact type of substance used to create the first layer. According to another embodiment, the substance the first layer is made from and the thickness of the first layer 101 are selected such that the first layer provides a desired pressure rating to the casing section 15 at the location of the window 16. The specific pressure differential can be the difference in pressure from the inside of the casing section 15 and the outside of the casing section, for example from the subterranean formation. The desired pressure rating can be the specific pressure differential. By way of example, the pressure differential in the wellbore at the location of the pre-milled window 16 might be 1,000 pounds force per square inch (psi); therefore, the desired pressure rating of the first layer 101 and/or the composite material could be 1,100 psi or greater.

The covering 100 is located on the outer surface of the body. The first layer 101 can be positioned directly onto the outer surface of the body, such that the bottom surface of the first layer 101 contacts the outer surface of the casing section 15. The first layer 101 can also serve as the base layer for the subsequent layers making up the composite material. The second layer 102 can be positioned directly onto the top surface of the first layer 101.

The composite material can also comprise a fourth layer (not shown) that is positioned on top of or adjacent to the first layer 101. This layer may be useful if the first layer 101 is not entirely capable of withstanding the specific pressure differential. In this manner, the pressure rating of the composite material can be increased to the desired pressure rating via the inclusion of one or more intermediate layers that add to the overall pressure rating of the composite material. The substances making up the pressure-bearing layer(s) can be selected to achieve the desired pressure rating.

The composite material also includes the second layer 102. The second layer 102 can be a structural layer, wherein the structural layer provides a desired strength to the composite material. The structural layer can increase the amount of applied stress the covering can withstand without failure. The stress can be, for example, compressive stress, tensile stress, or shear stress. According to an embodiment, the desired strength is approximately the same strength as the casing section 15. In this manner, once the covering 100 is placed onto the casing section 15 and covers the window 16, there is a uniform strength along the entire length of the casing section 15. The structural second layer 102 can comprise high-strength materials, such as carbon fiber. Preferably, the high-strength materials do not create a significant amount of debris when being milled or drilled through. Due to the impermeable pressure-bearing first layer 101, it is not necessary that the structural second layer 102 be impermeable to fluids.

The layers of the composite material can be adhered to one another in a variety of ways. By way of example, the layer can be made to fit tightly around the outer surface of the casing section 15 or another layer by shrinking in size via an application of heat (commonly called shrink-fit materials). One layer can also be adhered to another layer via an adhesive, such as a glue. The substance for a layer can also be heated to its melting point and then spray coated or extruded onto the outer surface of the casing section 15 or another layer. Accordingly, when the material cools, it is bonded to the casing section or the previous layer. An example of a substance capable of being spray coated or extruded in a liquefied state is a thermoplastic material. The substance for a layer can also be included as bands within a tape, wherein the tape can be wrapped around the outer surface of the casing section 15 or another layer. By way of yet another example, the substance for a layer can be woven onto the outer surface of the casing section 15 or another layer, wherein the woven substance is embedded within a glue matrix that binds the woven layer to the casing section or layer underneath. One of ordinary skill in the art will be able to select the appropriate method for adhering the layers of the composite to one another and adhering the composite material to the outer surface of the casing section 15 based on the exact substances used for each layer.

The following are some examples of creating the composite material with two or more layers using a variety of adhering techniques. The following examples are not the only examples that could be given and are not meant to limit the scope of this disclosure. A layer of the composite material can be spray-coated or extruded onto an outer surface of the casing section or another layer. Extrusion can include heating the substance of the layer to liquefy the substance and then injecting the liquefied substance onto the desired outer surface via an application head and nozzles. The application head can completely surround the outer surface whereby the application head can traverse the desired length of the casing section. An optional gauge mold can also be used to follow the application head as both traverse the length of the casing section. The gauge mold can have a specific inner diameter. The gauge mold can be moved slowly along the length of the casing section such that it forces the layer to have a uniform outer diameter upon cooling of the substance. For a shrink-fit material, the substance of the layer can be positioned around the outside of the casing section or other layer. The substance can then be heated such that the substance begins to shrink until the layer has tightly adhered to the outer surface of the casing section or other layer. An adhesive, such as a glue can also be applied to the outer surface of the casing section or other layer and then another layer can be placed on top of the adhesive. The adhesive can then be allowed to dry completely such that the layers are adhered to one another. The layer can also be wrapped around the outer surface of the casing section or other layer when the substance is in a tape form.

The thickness of each layer can be adjusted via the application technique. For example, for a liquefied substance, the thickness of the layer can be adjusted by how many passes the application head traverses the length of the casing section, the speed of travel along the length of the casing section, and the inner diameter of the gauge mold, among other things. The thickness can also be adjusted by how many passes are made by wrapping the substance in the form of a tape around the outer surface of the casing section or other layer. There can also be multiple layers of the same substance.

The composite material can also include a third layer 103. The third layer 103 can be, without limitation, a pressure-bearing layer, a structural layer, or a wear layer (e.g., a coating layer). As a wear layer, the third layer 103 can help to protect the structural second layer 102, for example, the carbon fiber, from the environment.

The covering 100 covers the window 16 and spans at least a sufficient distance beyond the perimeter of the window 16 such that the casing section 15 has a desired pressure rating at the location of the window 16. According to an embodiment, the layers of the composite material, the substances making up each layer, and the thickness of each layer are selected such that the composite material has a desired pressure rating and a desired strength. The desired pressure rating can be greater than or equal to the bottomhole pressure of the wellbore. The desired strength can be less than, greater than, or equal to the strength of the casing section, preferably greater than or equal to. A length of a casing section can be approximately 20 feet (6.1 meters). According to an embodiment, the covering 100 spans the entire length of the casing section 15 (as shown in FIG. 1A). As a result, the casing section 15 would have a uniform outer diameter along the entire length of the section.

Figure 2:
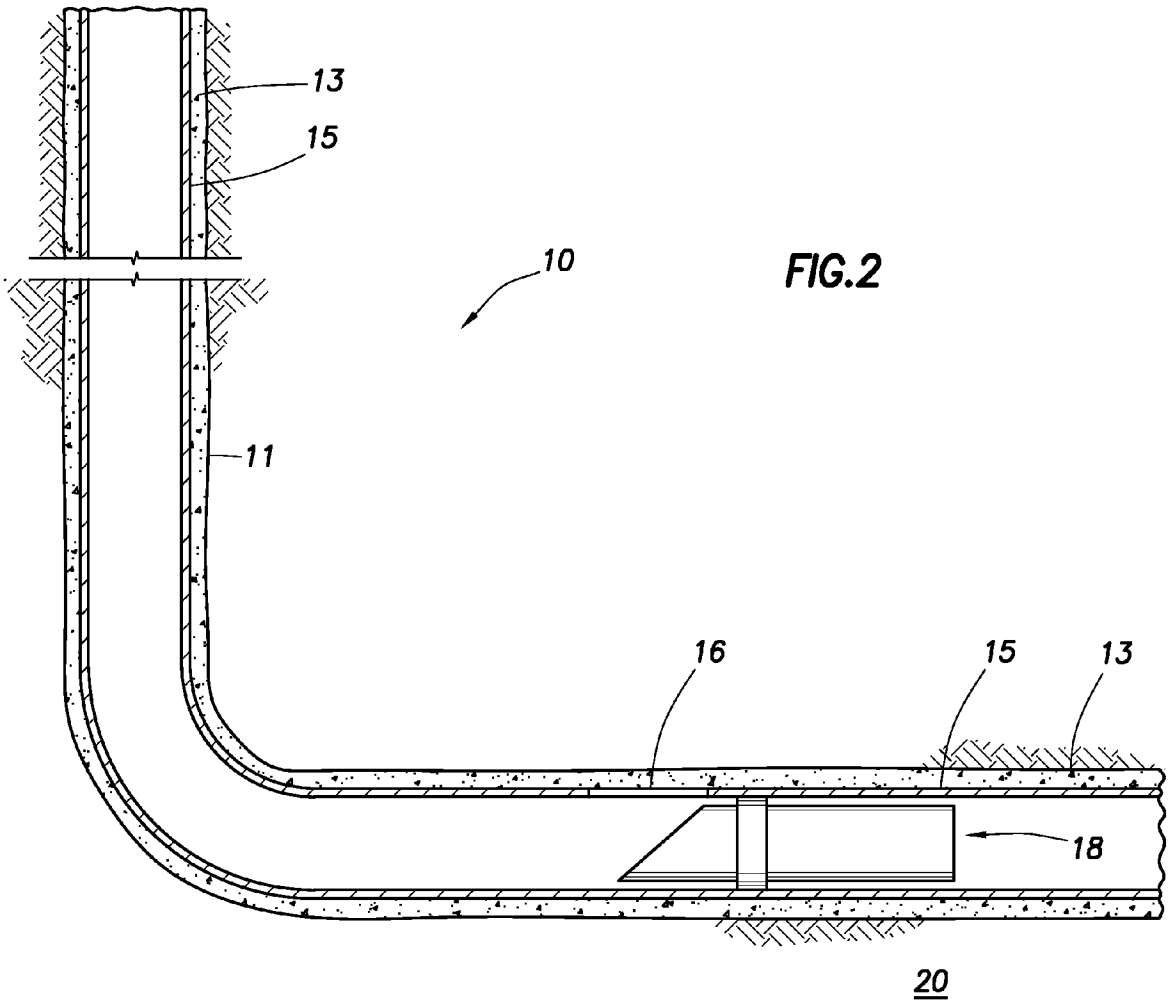
FIG. 2 is a schematic illustration of a well system including a mill diverter positioned in a wellbore adjacent to the pre-milled window of the section of casing.
Figure 3:
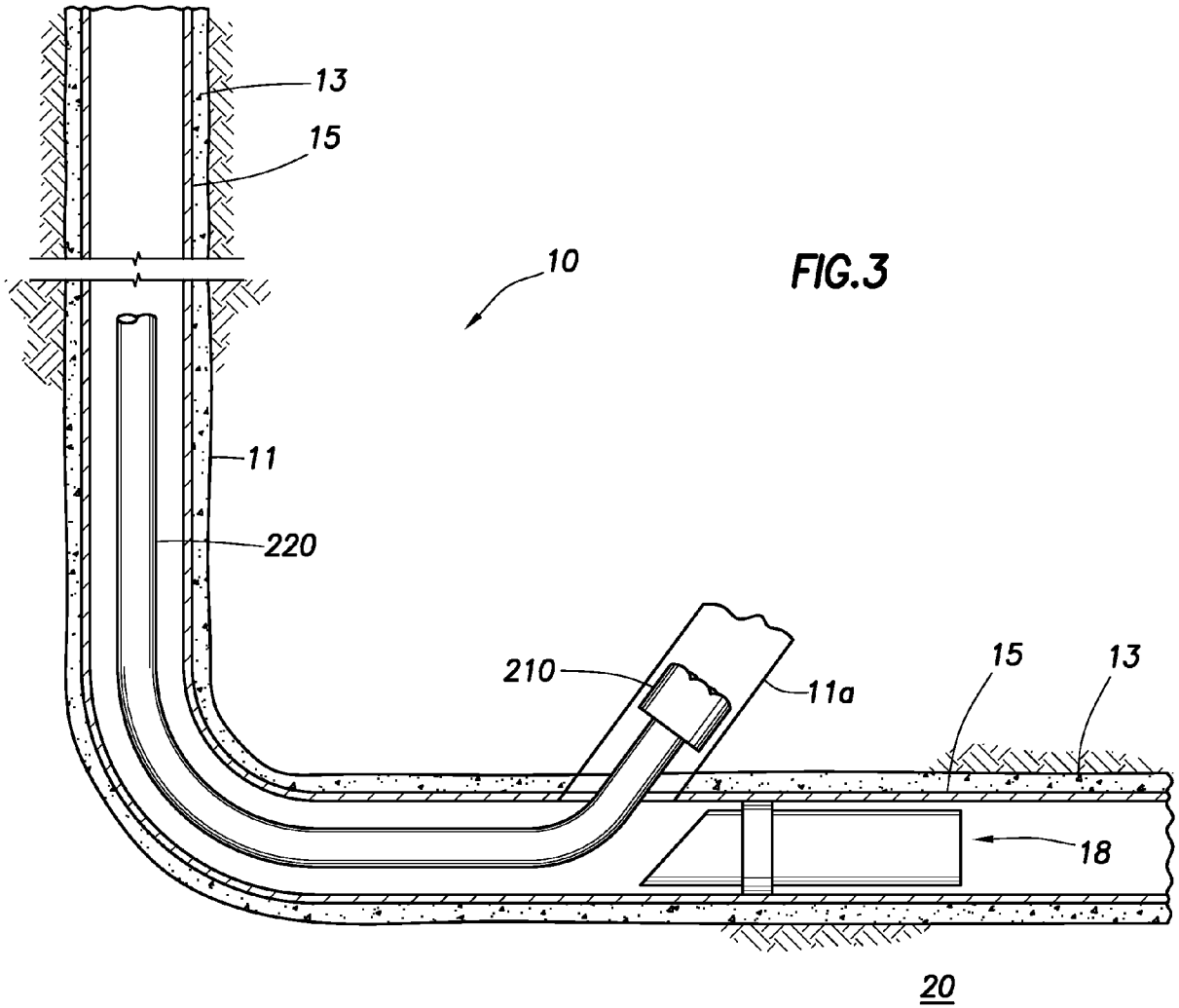
FIG. 3 is a schematic illustration from FIG. 2 showing a lateral wellbore being formed using a drill bit and the mill diverter through the pre-milled window.
Figure 4:
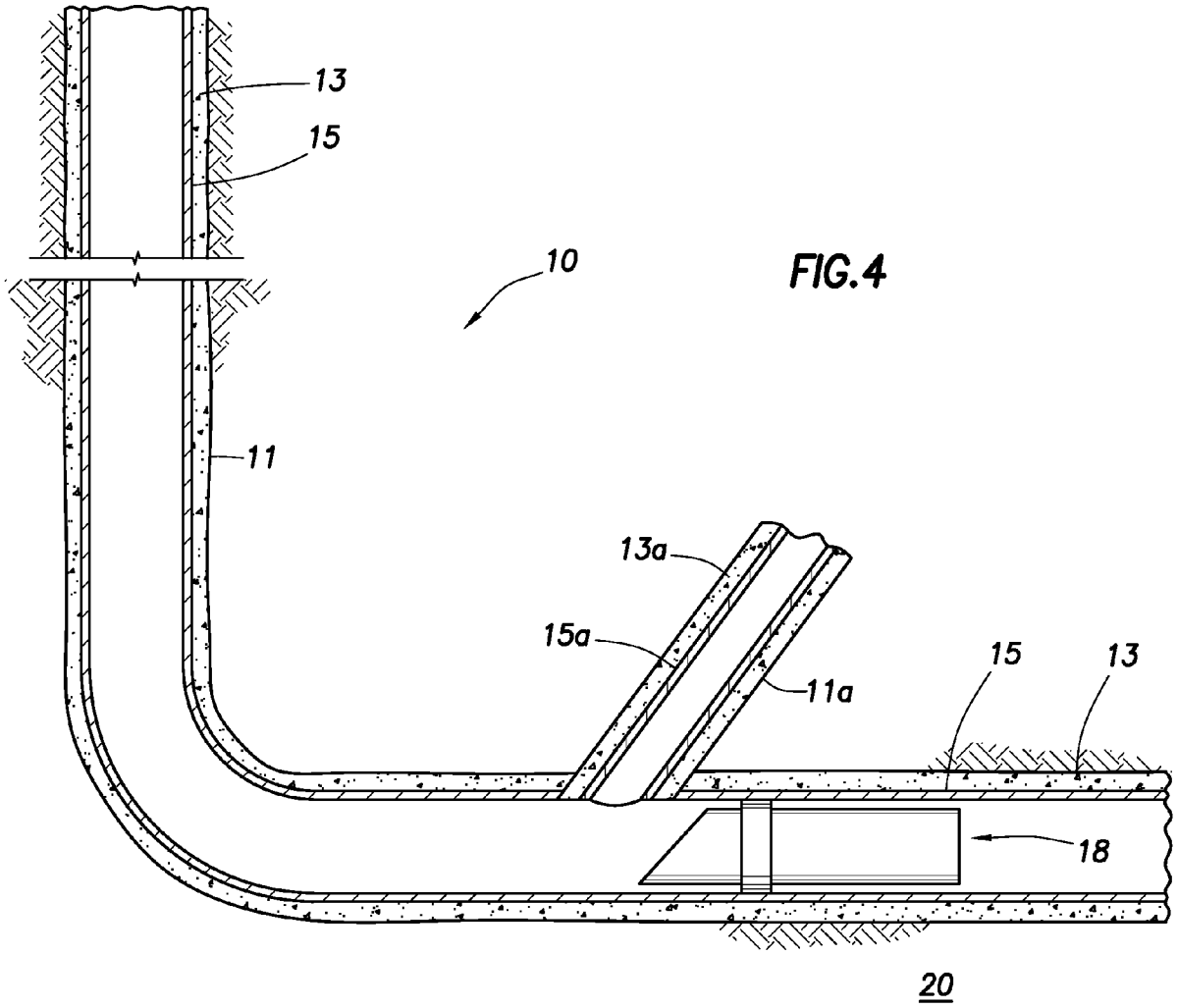
FIG. 4 is a schematic illustration from FIG. 3 showing the lateral wellbore completed.

FIGS. 2-4 depict a well system 10. The well system 10 can include a wellbore 11. The wellbore 11 extends into a subterranean formation 20. The wellbore 11 can be a primary wellbore or a lateral wellbore. The wellbore 11 can have vertical, horizontal, inclined, straight, or curved sections, and combinations thereof. At least a section of the wellbore 11 is a cased-hole wellbore. The cased-hole section can include the casing section 15. The casing section 15 can be cemented in the wellbore 11 via cement 13.

The methods include introducing a casing string into the wellbore 11, wherein the casing string comprises at least one casing section 15. Of course, more than one casing section 15 containing the pre-milled window 16 can be placed in the wellbore 11 for forming multiple lateral wellbores. The well system 10 can include a mill diverter 18. An example of a mill diverter 18 is a whipstock. The mill diverter 18 can be placed in the wellbore 11 inside the casing string. As can be seen in FIG. 2, the mill diverter 18 can comprises a body and a tapered face. The mill diverter 18 can also comprise a setting mechanism. The mill diverter 18 can be secured to the casing string via the setting mechanism at a location adjacent to the pre-milled window 16 of the casing section 15. Examples of suitable setting mechanisms include, but are not limited to, a packer, a latch, a liner hanger, a lock mandrel, an expanded tubular, mechanical slips, or a collet. The setting mechanism can function to secure the mill diverter 18 within the casing string at the desired location such that downward and rotational movement of the mill diverter 18 under force is inhibited, and preferably eliminated. The methods can further include the step of securing the mill diverter 18 in the casing string adjacent to the window 16 location, wherein the step of securing can be performed after the step of introducing the casing string into the wellbore 11.

The methods include drilling through at least a portion of the covering 100 from the inside of the casing string to expose the window 16. The methods can include introducing a drill bit 210 into the inside of the casing string. The drill bit 210 can be run into the wellbore on a tubing string, coiled tubing, or wireline 220. The drill bit 210 can then drill through one or more layers of the composite material traveling from a direction inside the casing string towards the outside of the casing string.

According to an embodiment, one or more of the layers of the composite material of the covering 100 undergo a phase transformation from a solid to a liquid or semi-liquid after introduction into the wellbore. By way of example, the one or more layers can melt at the bottomhole temperature of the wellbore. As used herein, the term "bottomhole" means at the location within the wellbore where the pre-milled window 16 is located. By way of another example, the one or more layers can dissolve in a solvent. Moreover, portions of the layer(s) can also undergo the phase transformation, for example, a glue matrix binder. The solvent can be a fluid that is introduced into the wellbore (e.g., as a spot solvent) or it can be a reservoir fluid. A heated fluid can also be introduced into the wellbore to cause the layer(s) or portions of the layer(s) to melt. These embodiments may be useful for a further reduction in the amount of debris created during the drilling through the covering 100. According to these embodiments, the substance selected for the layer(s) that are to undergo the phase transformation can be selected such that the layer(s) undergo the phase transformation within a desired period of time. By way of example, the substance can be selected such that once the casing section 15 reaches the desired location within the wellbore 11 the substance undergoes the phase transformation. Accordingly, the drill bit may only have to drill through the second layer 102.

The methods include the step of forming a lateral wellbore 11*a* adjacent to the exposed window. As can be seen in FIG. 3, the drill bit 210, upon encountering the tapered face of the mill diverter 18, can be diverted away from the center axis of the casing section 15. In this manner, the drill bit can start to engage the inside of the composite material of the covering 100. The drill bit drills through all of, or the remaining layers of the composite material of the covering 100 to expose the pre-milled window 16. The drill bit 210 can then drill through the cement 13. The drill bit 210 can then drill into the subterranean formation 20 to create the lateral wellbore 11*a*. There can also be more than one lateral wellbore formed using the principles of this disclosure. The wellbore 11 can be a primary wellbore or a lateral wellbore. The lateral wellbore 11*a* that is formed can be a primary, secondary, tertiary, etc. lateral wellbore.

As can be seen in FIG. 4, the lateral wellbore 11*a* can be completed after the step of forming the lateral wellbore. The completion of the lateral wellbore 11*a* can include introducing a casing string 15*a* into the lateral wellbore and can also include introducing a cement composition 13*a* into the annulus between the outside of the casing string and the wall of the lateral wellbore.

The methods can further include producing a reservoir fluid, such as oil or gas, from the subterranean formation 20. The step of producing can include producing the oil or gas via a production well.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. While compositions and methods are described in terms of "comprising," "containing," or "including" various components or steps, the compositions and methods can also "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b,") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A casing section comprising:

a body comprising a wall;

a window, wherein the window is an opening in the wall of the body; and a covering, wherein the covering:

(A) is composed of a composite material; wherein the composite material comprises a first layer, wherein the first layer is a pressure-bearing layer that is capable of withstanding a specific pressure differential; wherein the first layer is impermeable and inert to fluids that come in contact with the first layer;

(B) is located on the outer surface of the body;

(C) covers the window; and (D) spans at least a sufficient distance beyond the perimeter of the window such that the casing section has a desired pressure rating at the location of the window.

2. The casing section according to claim 1, wherein the casing section is part of a casing string.

3. The casing section according to claim 1, wherein the shape and size of the window are selected such that a lateral wellbore can be formed without having to enlarge the perimeter of the window.

4. The casing section according to claim 1, wherein the thickness of the first layer is selected such that at least the first layer can withstand the specific pressure differential.

5. The casing section according to claim 1, wherein the substance the first layer is made from and the thickness of the first layer are selected such that the first layer provides a desired pressure rating to the casing section at the location of the window.

6. The casing section according to claim 1, wherein the composite material further comprises an additional pressure-bearing layer, and wherein the additional pressure-bearing layer increases the pressure rating of the composite material.

7. The casing section according to claim 1, wherein the composite material further comprises a second layer, wherein the second layer is a structural layer, and wherein the structural layer provides a desired strength to the composite material.

8. The casing section according to claim 7, wherein the desired strength is approximately the same strength as the casing section.

9. The casing section according to claim 8, wherein the second layer comprises a high-strength material.

10. The casing section according to claim 9, wherein the high-strength material is carbon fiber.

11. The casing section according to claim 7, wherein the layers of the composite material, the substances making up each layer, and the thickness of each layer are selected such that the composite material has a desired pressure rating and a desired strength.

12. The casing section according to claim 11, wherein the desired pressure rating is greater than or equal to the bottomhole pressure of a wellbore containing the casing section.

13. The casing section according to claim 11, wherein the desired strength is less than, greater than, or equal to the strength of the casing section.

14. The casing section according to claim 1, wherein the covering spans the entire length of the casing section.

15. A method of creating a lateral wellbore in a subterranean formation comprising:

introducing a casing string into a wellbore, wherein the casing string comprises at least one casing section, wherein the casing section comprises:

(A) a body comprising a wall;

(B) a window, wherein the window is an opening in the wall of the body; and (C) a covering, wherein the covering:

(i) is composed of a composite material; wherein the composite material comprises two or more layers, and wherein one or more of the layers of the composite material undergo a phase transformation from a solid to a liquid or semi-liquid after introduction into the wellbore;

(ii) is located on the outer surface of the body;

(iii) covers the window; and (iv) spans at least a sufficient distance beyond the perimeter of the window such that the casing section has a desired pressure rating at the location of the window;

drilling through at least a portion of the covering from the inside of the casing string to expose the window; and forming the lateral wellbore adjacent to the exposed window.

16. The method according to claim 15, wherein the one or more of the layers of the composite material melt at the bottomhole temperature of the wellbore.

17. The method according to claim 15, wherein the one or more of the layers of the composite material dissolve in a solvent.

18. The method according to claim 15, wherein the lateral wellbore is completed after the step of forming the lateral wellbore.

19. The method according to claim 15, further comprising producing a reservoir fluid from the subterranean formation, wherein the lateral wellbore penetrates the subterranean formation.

* * * * *